US009801502B2

(12) United States Patent
Ogbuagu

(10) Patent No.: US 9,801,502 B2
(45) Date of Patent: Oct. 31, 2017

(54) TOOTHBRUSH STORAGE SYSTEM

(71) Applicant: Augustine Obi Ogbuagu, Santa Clarita, CA (US)

(72) Inventor: Augustine Obi Ogbuagu, Santa Clarita, CA (US)

( * ) Notice: Subject to any disclaimer, the term of this patent is extended or adjusted under 35 U.S.C. 154(b) by 207 days.

(21) Appl. No.: 14/820,912

(22) Filed: Aug. 7, 2015

(65) Prior Publication Data

US 2017/0035254 A1 Feb. 9, 2017

(51) Int. Cl.
*B65D 83/10* (2006.01)
*A47K 1/09* (2006.01)

(52) U.S. Cl.
CPC ..... *A47K 1/09* (2013.01)

(58) Field of Classification Search
USPC ..... 206/361, 362.1, 362.2, 362, 362.3, 15.2, 206/15.3
See application file for complete search history.

(56) References Cited

U.S. PATENT DOCUMENTS

| | | | | |
|---|---|---|---|---|
| D144,535 | S | 4/1946 | Beilock | |
| 3,881,868 | A | 5/1975 | Duke | |
| 4,978,003 | A * | 12/1990 | Foster | A47K 1/09 132/308 |
| D324,792 | S | 3/1992 | McElroy | |
| 5,522,497 | A | 6/1996 | Stacy | |
| 5,922,292 | A * | 7/1999 | Hecker | A47K 1/09 206/209.1 |
| 6,186,324 | B1 | 2/2001 | Catterson | |
| RE37,535 | E | 2/2002 | Avery et al. | |
| 7,207,437 | B1 * | 4/2007 | Johansson | B44D 3/125 206/15.3 |
| 7,617,927 | B1 | 11/2009 | Smith, Jr. | |
| 2011/0174823 | A1 | 7/2011 | Silva | |

* cited by examiner

*Primary Examiner* — Jacob K Ackun

(57) ABSTRACT

A toothbrush storage system for containing fluid dripping from a toothbrush includes a toothbrush. A container is provided and the container has the toothbrush positioned therein. Thus, the container may have a fluid dripping from the toothbrush pass through the container. A pan is removably coupled to the container such that the pan may capture the fluid passing through the container.

5 Claims, 4 Drawing Sheets

TOOTHBRUSH STORAGE SYSTEM

BACKGROUND OF THE DISCLOSURE

Field of the Disclosure

The disclosure relates to storage devices and more particularly pertains to a new storage device for containing fluid dripping from a toothbrush.

SUMMARY OF THE DISCLOSURE

An embodiment of the disclosure meets the needs presented above by generally comprising a toothbrush. A container is provided and the container has the toothbrush positioned therein. Thus, the container may have a fluid dripping from the toothbrush pass through the container. A pan is removably coupled to the container such that the pan may capture the fluid passing through the container.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
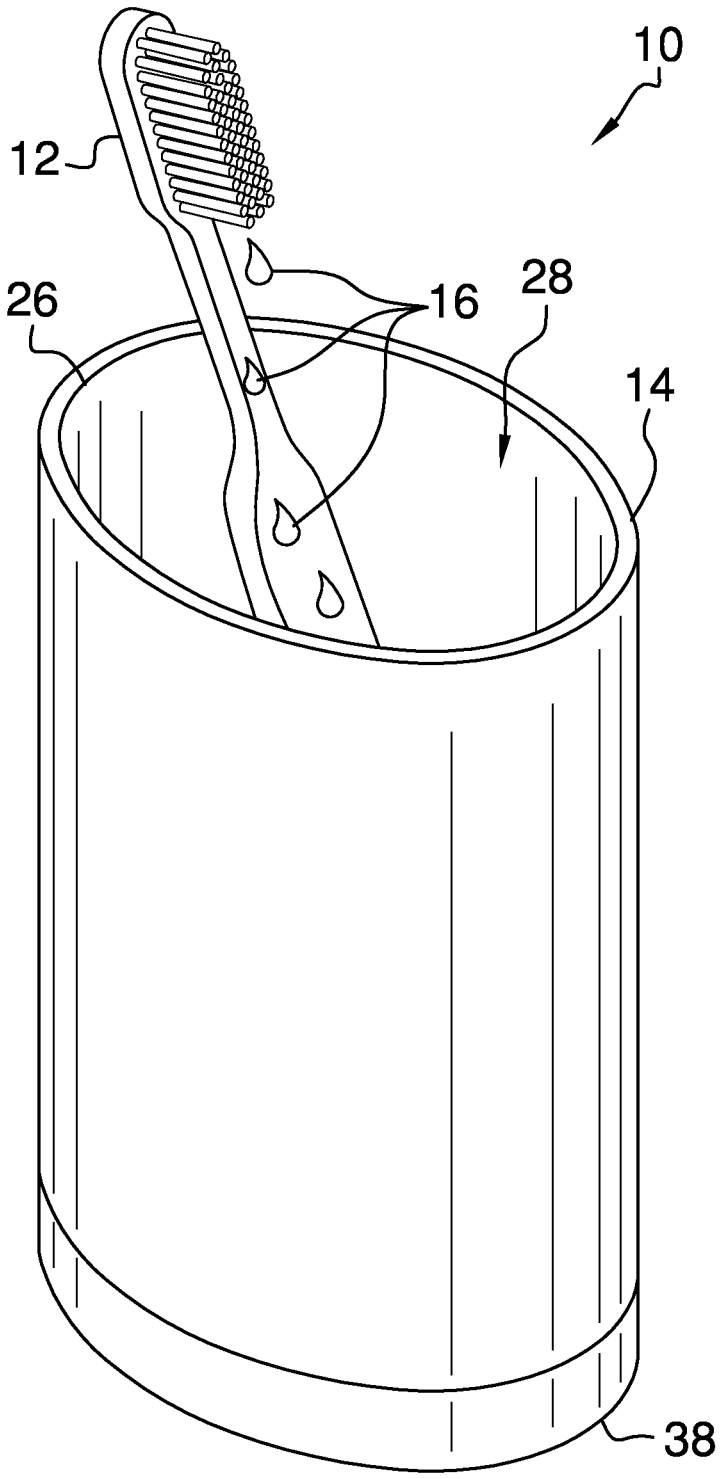
FIG. 1 is a perspective view of a toothbrush storage system according to an embodiment of the disclosure.
Figure 2:
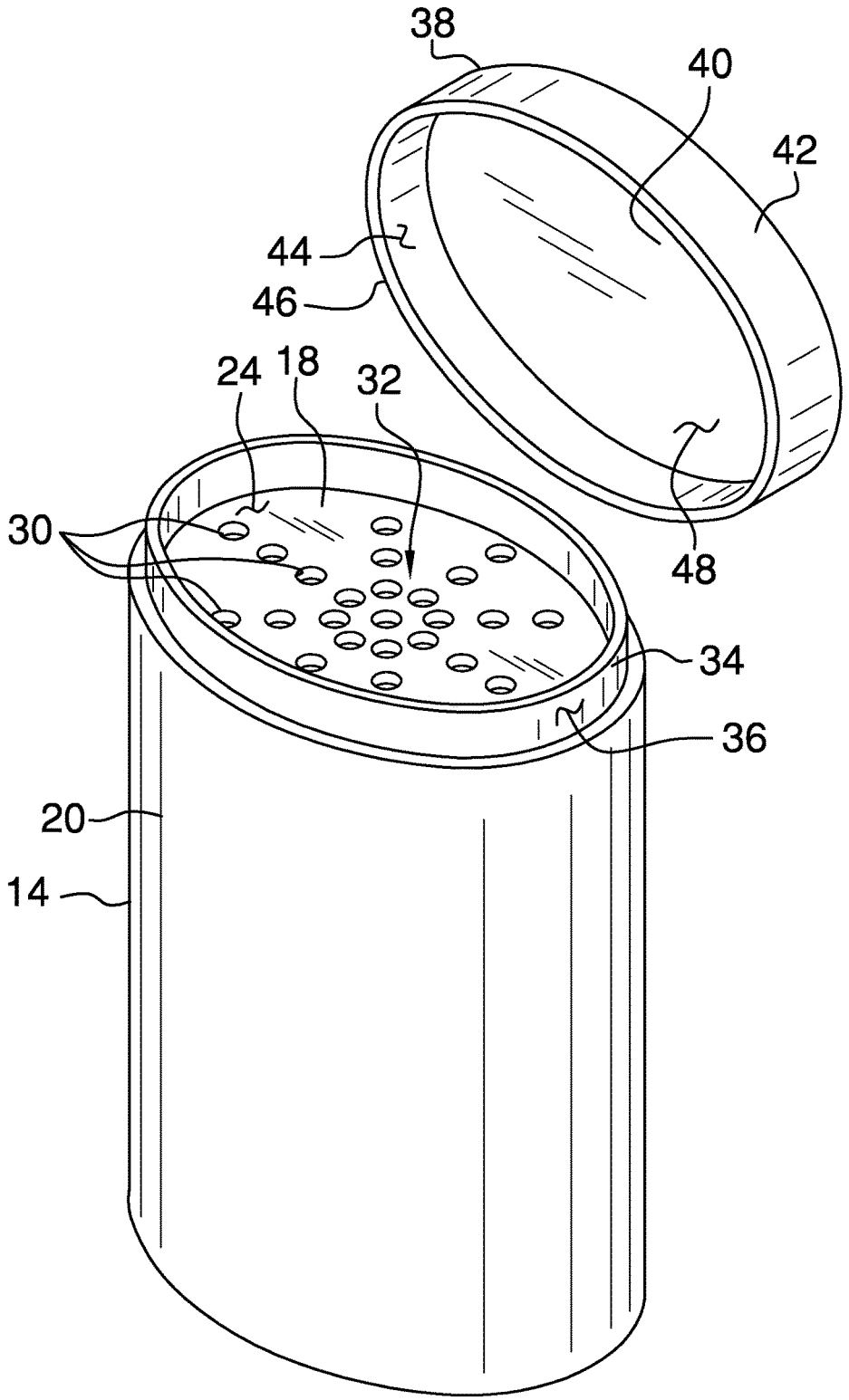
FIG. 2 is a bottom perspective view of an embodiment of the disclosure.
Figure 3:
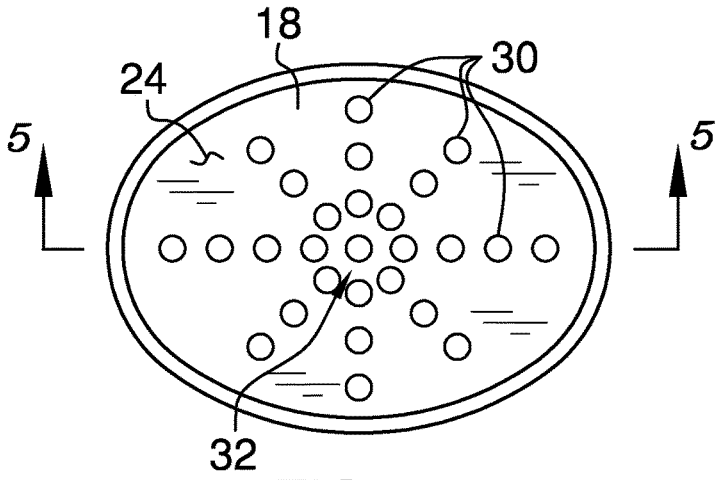
FIG. 3 is a bottom view of an embodiment of the disclosure.
Figure 4:
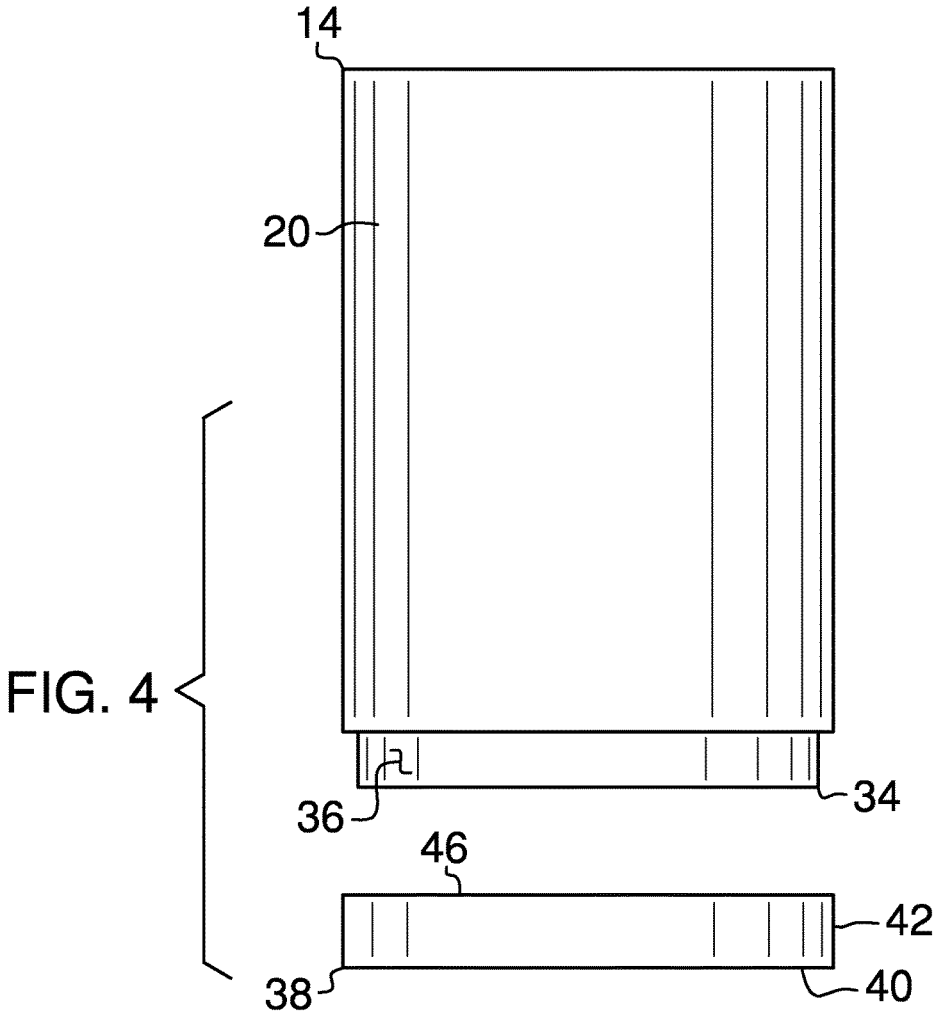
FIG. 4 is a right side exploded view of an embodiment of the disclosure.
Figure 5:
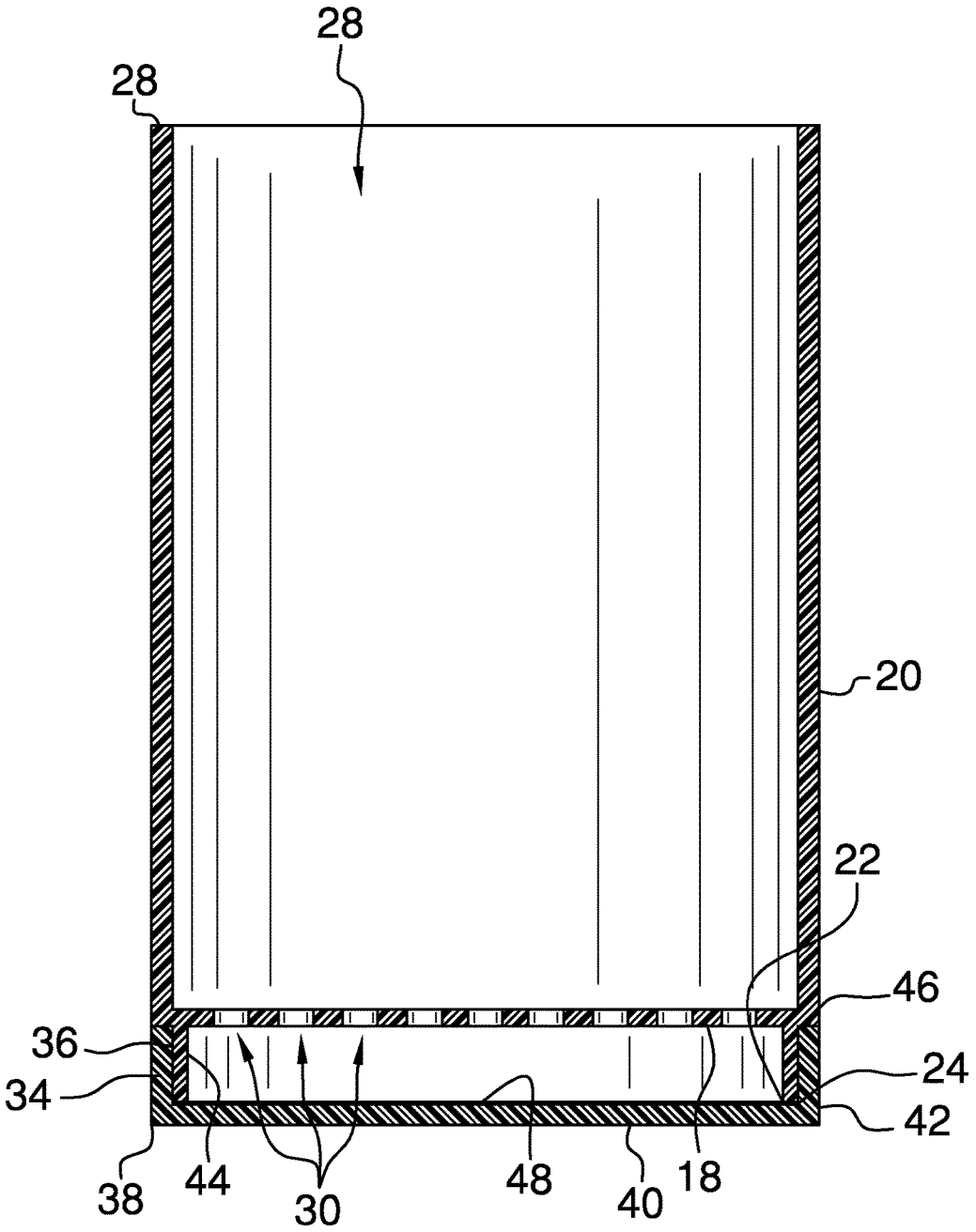
FIG. 5 is a cross sectional view taken along line 5-5 of FIG. 3 of an embodiment of the disclosure.

With reference now to the drawings, and in particular to FIGS. 1 through 5 thereof, a new storage device embodying the principles and concepts of an embodiment of the disclosure and generally designated by the reference numeral 10 will be described.

As best illustrated in FIGS. 1 through 5, the toothbrush storage system 10 generally comprises a toothbrush 12. A container 14 and the container 14 may have a fluid 16 dripping from the toothbrush 12 pass through the container 14 when toothbrush 12 is positioned in the container 14. The fluid 16 may comprise water.

The container 14 has a bottom wall 18 and a peripheral wall 20 extending upwardly from the bottom wall 18. The bottom wall 18 has a top surface 22 and a bottom surface 24. The peripheral wall 20 is curved such that the container 14 has an ovoid cylindrical shape. The peripheral wall 20 has a distal edge 26 with respect to the bottom wall 18 and the distal edge 26 defines an opening 28 into the container 14. The toothbrush 12 is inserted into the opening 28 such that the toothbrush 12 rests on the top surface 22 of the bottom wall 18.

The bottom wall 18 has a plurality of openings 30 extending through the top surface 22 and the bottom surface 24. Thus, the openings 30 may have the fluid 16 pass therethrough. The openings 30 are arranged to radiate outwardly between a center 32 of the bottom wall 18 and the peripheral wall 20. The bottom wall 18 has a lip 34 that is coupled to and extends downwardly from the bottom surface 24. The lip 34 is spaced inwardly from the peripheral wall 20 and the lip 34 is coextensive with the peripheral wall 20 such that the lip 34 surrounds the openings 30. The lip 34 has an outwardly facing surface 36.

A pan 38 is removably coupled to the container 14 such that the pan 38 may capture the fluid 16 passing through the container 14. The pan 38 has a lower wall 40 and a perimeter wall that 42 is coupled to and extends upwardly from the lower wall 40. The perimeter wall 42 is curved such that the pan 38 has an ovoid shape. The perimeter wall 42 has an inwardly facing surface 44 and a distal edge 46 with respect to the lower wall 40. The lower wall 40 has a first surface 48. The pan 38 is positioned on the container 14 such that the outwardly facing surface 36 of the lip 34 engages the inwardly facing surface 44 of the perimeter wall 42 and the distal edge 46 of the pan 38 abuts the first surface 48. Thus, the pan 38 may capture the fluid 16 passing through the openings 30.

In use, the pan 38 is positioned on the container 14 and the toothbrush 12 is positioned in the container 12 after the toothbrush 12 has been utilized. The fluid 16 on the toothbrush 12 passes through the openings 30 thereby facilitating the fluid 16 to be retained within the pan 38. The pan 38 is removed from the container 14 such that the fluid 16 may be poured out of the pan 38. Additionally, the pan 38 is removed from the container 14 to facilitate the pan 38 to be cleaned.

With respect to the above description then, it is to be realized that the optimum dimensional relationships for the parts of an embodiment enabled by the disclosure, to include variations in size, materials, shape, form, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A toothbrush storage system comprising:

a toothbrush;

a container being configured to have a fluid dripping from said toothbrush pass through said container when said toothbrush is positioned in said container, said container having a bottom wall and a peripheral wall extending upwardly from said bottom wall, said bottom wall having a top surface and a bottom surface, said peripheral wall being curved such that said container has an ovoid cylindrical shape, said peripheral wall having a distal edge with respect to said bottom wall, said distal edge defining an opening into said container, said toothbrush being inserted into said opening such that said toothbrush rests on said top surface, said bottom wall having a plurality of openings extending through said top surface and said bottom surface wherein said openings are configured to have the fluid pass therethrough, said openings being arranged to radiate outwardly between a center of said bottom wall and said peripheral wall wherein said openings are positioned for draining an entirety of said container within said peripheral wall; and a pan being removably coupled to said container wherein said pan is configured to capture the fluid passing through said container.

2. The system according to claim 1, wherein said bottom wall has a lip being coupled to and extending downwardly from said bottom surface, said lip being spaced inwardly from said peripheral wall, said lip being coextensive with said peripheral wall such that said lip surrounds said openings, said lip having an outwardly facing surface.

3. The system according to claim 1, wherein said pan has a lower wall and a perimeter wall being coupled to and extending upwardly from said lower wall, said perimeter wall being curved such that said pan has an ovoid shape, said perimeter wall having an inwardly facing surface and a distal edge with respect to said lower wall, said lower wall having a first surface.

4. The system according to claim 3, further comprising said container having a bottom wall;

a lip having an outwardly facing surface; and said pan being positioned on said container such that said outwardly facing surface of said lip engages said inwardly facing surface of said perimeter wall and said distal edge abuts said bottom wall wherein said pan is configured to capture the fluid passing through said openings.

5. A toothbrush storage system comprising:

a toothbrush;

a container being configured to have a fluid dripping from said toothbrush pass through said container when said toothbrush is positioned in said container, said container having a bottom wall and a peripheral wall extending upwardly from said bottom wall, said bottom wall having a top surface and a bottom surface, said peripheral wall being curved such that said container has an ovoid cylindrical shape, said peripheral wall having a distal edge with respect to said bottom wall, said distal edge defining an opening into said container, said toothbrush being inserted into said opening such that said toothbrush rests on said top surface, said bottom wall having a plurality of openings extending through said top surface and said bottom surface wherein said openings are configured to have the fluid pass therethrough, said openings being arranged to radiate outwardly between a center of said bottom wall and said peripheral wall wherein said openings are positioned for draining an entirety of said container within said peripheral wall, said bottom wall having a lip being coupled to and extending downwardly from said bottom surface, said lip being spaced inwardly from said peripheral wall, said lip being coextensive with said peripheral wall such that said lip surrounds said openings, said lip having an outwardly facing surface; and a pan being removably coupled to said container wherein said pan is configured to capture the fluid passing through said container, said pan having a lower wall and a perimeter wall being coupled to and extending upwardly from said lower wall, said perimeter wall being curved such that said pan has an ovoid shape, said perimeter wall having an inwardly facing surface and a distal edge with respect to said lower wall, said lower wall having a first surface, said pan being positioned on said container such that said outwardly facing surface of said lip engages said inwardly facing surface of said perimeter wall and said distal edge of said pan abuts said bottom wall wherein said pan is configured to capture the fluid passing through said openings.

* * * * *